US011826868B2

(12) United States Patent
Kim et al.

(10) Patent No.: US 11,826,868 B2
(45) Date of Patent: Nov. 28, 2023

(54) POLISHING SIDE SURFACES OF FIBERS

(71) Applicant: Government of the United States, as represented by the Secretary of the Air Force, Wright-Patterson AFB, OH (US)

(72) Inventors: Hyunjun Kim, Centerville, OH (US); Randall G. Corns, Centerville, OH (US); Randall S. Hay, Beavercreek, OH (US); Augustine M. Urbas, Oakwood, OH (US)

(73) Assignee: United States of America as represented by the Secretary of the Air Force, Wright-Patterson AFB, OH (US)

( * ) Notice: Subject to any disclaimer, the term of this patent is extended or adjusted under 35 U.S.C. 154(b) by 776 days.

(21) Appl. No.: 16/217,700

(22) Filed: Dec. 12, 2018

(65) Prior Publication Data

US 2020/0094367 A1 Mar. 26, 2020

Related U.S. Application Data

(60) Provisional application No. 62/736,490, filed on Sep. 26, 2018.

(51) Int. Cl.

| | |
|---|---|
| ***B24B 5/38*** | (2006.01) |
| ***B24D 15/04*** | (2006.01) |
| ***B24B 29/08*** | (2006.01) |
| ***B24B 27/00*** | (2006.01) |
| ***B24D 15/02*** | (2006.01) |

(52) U.S. Cl.

CPC ..... *B24B 29/08* (2013.01); *B24B 5/38* (2013.01); *B24B 27/0076* (2013.01); *B24D 15/023* (2013.01); *B24D 15/04* (2013.01)

(58) Field of Classification Search

CPC ..... B24B 5/38; B24B 21/025; B24B 27/0076; B24B 29/06; B24B 29/08; B24B 37/022; B24D 15/02; B24D 15/023; B24D 15/04

USPC ..... 451/59, 164, 167, 176, 314, 317, 909, 451/552, 55

See application file for complete search history.

(56) References Cited

U.S. PATENT DOCUMENTS 3,633,318 A * 1/1972 Olivotto ..... B24B 5/38 451/211
3,906,676 A * 9/1975 Orlando, Sr. ..... B24B 5/38 29/81.05
3,986,301 A * 10/1976 Lough ..... B24B 9/002 451/261

(Continued)

OTHER PUBLICATIONS

Kim, Hyunjun, et al., Lasing of surface-polished polycrystalline Ho: YAG (yttrium aluminum garnet) fiber; Opt. Express 25(6) 6725-31(2017).

(Continued)

*Primary Examiner* — Eileen P Morgan
(74) *Attorney, Agent, or Firm* — AFMCLO/JAZ; Charles R. Figer, Jr.

(57) ABSTRACT

Apparatuses and associated methods for polishing side surfaces of fibers. The system includes a fiber loading mechanism for securing a fiber to the apparatus, a polishing mechanism, and a linear motion mechanism for linearly translating one of the polishing mechanism and the fiber for polishing a side surface of the fiber using the polishing mechanism.

17 Claims, 7 Drawing Sheets

(56) References Cited

U.S. PATENT DOCUMENTS

| | | | | |
|---|---|---|---|---|
| 4,045,837 | A * | 9/1977 | Mandras | B24B 5/38 15/97.1 |
| 4,827,676 | A * | 5/1989 | Kindermann | B24B 19/226 451/194 |
| 4,850,148 | A * | 7/1989 | Takatsu | B24B 19/226 451/302 |
| 5,016,398 | A * | 5/1991 | Fukunaga | B24B 29/005 451/194 |
| 5,136,818 | A | 8/1992 | Bramson | |
| 5,295,278 | A * | 3/1994 | Condon | B25B 9/02 15/118 |
| 5,331,773 | A * | 7/1994 | Biancalani | D06B 11/0096 8/138 |
| 5,480,342 | A * | 1/1996 | Bannayan | B24B 5/18 451/6 |
| 5,743,787 | A | 4/1998 | Shiyama et al. | |
| 5,888,119 | A | 3/1999 | Christianson et al. | |
| 6,099,392 | A | 8/2000 | Wiegand et al. | |
| 6,165,055 | A | 12/2000 | Takahashi et al. | |
| 6,171,177 | B1 * | 1/2001 | Fitz | G02B 6/4498 451/313 |
| 6,244,930 | B1 * | 6/2001 | Archilla | B24B 5/38 451/6 |
| 6,439,965 | B1 | 8/2002 | Ichino et al. | |

OTHER PUBLICATIONS

Zhong, Nianbing, et al., Effects of surface roughness on optical properties and sensitivity of fiber-optic evanescent wave sensors, Appl. Opt. 52(17), 393(2013).

* cited by examiner

POLISHING SIDE SURFACES OF FIBERS

CROSS-REFERENCE TO RELATED APPLICATIONS

This application claims the benefit of and priority to U.S. Provisional Application Ser. No. 62/736,490, entitled "Apparatus for Polishing Side Surfaces of Fibers," filed on Sep. 26, 2018, the entirety of which is incorporated by reference herein.

GOVERNMENT INTEREST

The invention described herein may be manufactured and used by or for the Government of the United States for all government purposes without the payment of any royalty.

FIELD OF THE INVENTION

The present invention relates generally to polishing fibers. More particularly, the present invention relates to polishing the side surfaces of thin fibers such as ceramic fibers.

BACKGROUND OF THE INVENTION

Ceramic fibers are small-dimensional filaments or threads composed of a ceramic material, typically alumina, silicon carbide, and silica, often used in composite reinforcements, optical devices, and other high temperature applications. For example, transparent single crystal and polycrystalline ceramic fibers are currently being developed for optical and laser applications. Based on factors such as the fabrication processes used for producing the fibers, particular materials of the fibers, etc., side surfaces of the fibers are often rough or otherwise suffer from small surface defects. In particular, the side surfaces of polycrystalline ceramic fibers tend to be relatively rough because of grain boundary grooving during the fabrication process. Similarly, faceting and/or stepwise pullout for production of single crystal fibers results in relatively rough side surfaces of these fibers.

Though the side surfaces of ceramic fibers for structural applications are not as smooth as glass fibers, their tensile strength is typically between about 2-3 GPa. As a result of their high strength, surface roughness has not been a significant issue for structural applications (e.g., composite reinforcements) of ceramic fibers. On the other hand, a high surface roughness has been found to often impact performance of the fibers for optical applications. For example, a high surface roughness for transparent polycrystalline ceramic fibers results in high scattering coefficients for the fibers, which is detrimental for optical applications of the fibers.

Additionally, it may also be desired to reduce, provide consistency, or otherwise control the diameter of small-diameter fibers such as ceramic fibers after fiber production. However, there is no current system for altering the diameter of fibers post-production.

What is needed therefore is a system for efficiently and effectively polishing side surfaces of small-diameter fibers such as ceramic fibers. In addition to removing surface imperfections, a system for controlling/reducing the diameter of ceramic fibers after fiber production is desired.

SUMMARY OF THE INVENTION

According to one embodiment of the invention, the above and other needs are met by an apparatus for polishing a side surface of a fiber that includes a fiber loading mechanism, a polishing mechanism, and a linear motion mechanism. The fiber loading mechanism positions the fiber with respect to the apparatus. The polishing mechanism includes at least a first polishing pad having a first polishing surface and a second polishing pad having a second polishing surface. The polishing mechanism is configured to clamp the first polishing pad and the second polishing pad together such that the first polishing surface contacts the second polishing surface with a portion of the fiber disposed between the first and second polishing surfaces. The linear motion mechanism linearly translates one of the polishing mechanism and the fiber for polishing a side surface of the fiber after the first polishing pad and the second polishing pad are clamped together with the portion of the fiber disposed between the first and second polishing surfaces.

According to certain embodiments, the fiber loading mechanism is configured to axially rotate to thereby axially rotate the fiber secured to the fiber loading mechanism.

According to certain embodiments, the linear motion mechanism is configured to linearly translate the polishing mechanism while the fiber loading mechanism is stationary. According to other embodiments, the linear motion mechanism is configured to linearly translate the fiber while the polishing mechanism is stationary.

According to certain embodiments, the fiber loading mechanism includes a plurality of rollers and the linear motion mechanism is configured to linearly translate the fiber between the plurality of rollers.

According to certain embodiments, the polishing mechanism is configured to clamp the first polishing pad to the second polishing pad according to a plurality of clamping pressures.

According to certain embodiments, the apparatus further includes a tensioning mechanism to provide a desired tension to the fiber.

According to another embodiment of the invention, a method of polishing side surfaces of a fiber includes providing a polishing apparatus having a fiber loading mechanism, a polishing mechanism, and a linear motion mechanism for linearly translating one of the polishing mechanism and the fiber. The polishing mechanism includes at least a first polishing pad having a first polishing surface and a second polishing pad having a second polishing surface. The polishing mechanism is configured to clamp the first polishing pad and the second polishing pad together. The method further includes positioning the fiber in the fiber loading mechanism such that a portion of the fiber is disposed between the first polishing pad and second polishing pad of the polishing mechanism; clamping the first polishing pad and the second polishing pad together such that the first polishing surface contacts the second polishing surface with the portion of the fiber disposed between the first and second polishing surfaces; and linearly translating one of the polishing mechanism and the fiber for polishing at least a first side surface of the fiber.

According to certain embodiments, the linearly translating step includes linearly translating the polishing mechanism for polishing the first side surface of the fiber, and the method further includes unclamping the first polishing pad and the second polishing pad; axially rotating the fiber loading mechanism to thereby axially rotate the fiber secured to the fiber loading mechanism; re-clamping the first polishing pad and the second polishing pad together with the axially rotated fiber disposed between the first and second polishing surfaces; and linearly translating the polishing mechanism for polishing at least a second side surface of the fiber.

According to certain embodiments, the method further includes selecting a clamping pressure for application of the polishing mechanism against the fiber based on the strength of the fiber being polished.

According to certain embodiments, the linearly translating step includes linearly translating the polishing mechanism while the fiber loading mechanism is stationary. In other embodiments, the linearly translating step includes linearly translating the fiber while the polishing mechanism is stationary.

According to certain embodiments, the apparatus further includes a tensioning mechanism, and the method further includes adjusting a tension of the fiber by modifying the tensioning mechanism.

According to certain embodiments, the fiber includes a maximum diameter of one millimeter or less. In certain embodiments, the fiber is one of a monocrystalline, polycrystalline, and amorphous ceramic fiber having a maximum diameter of one millimeter or less.

According to certain embodiments, the fiber loading mechanism includes a plurality of rollers and the linearly translating step includes linearly translating the fiber between the plurality of rollers while the polishing mechanism is stationary. In some embodiments, the plurality of rollers includes at least a first spool and a second spool, and the linearly translating step includes unwinding the fiber from the first spool while re-winding the fiber with the second spool.

According to yet another embodiment of the invention, an apparatus for polishing a side surface of a fiber includes a fiber loading mechanism having a plurality of rollers for positioning the fiber with respect to the apparatus, a polishing mechanism, and a drive mechanism for linearly translating the fiber between the plurality of rollers such that the fiber transverses the polishing mechanism for polishing a side surface of the fiber.

According to certain embodiments, the plurality of rollers includes one or more spools for unwinding the fiber prior to polishing or winding the polished portion of fiber after polishing is completed.

According to certain embodiments, one or more of the rollers include an abrasive surface for forming the polishing mechanism.

BRIEF DESCRIPTION OF THE DRAWINGS

Other embodiments of the invention will become apparent by reference to the detailed description in conjunction with the figures, wherein elements are not to scale so as to more clearly show the details, wherein like reference numbers indicate like elements throughout the several views, and wherein.

DETAILED DESCRIPTION OF THE INVENTION

Figure 1:
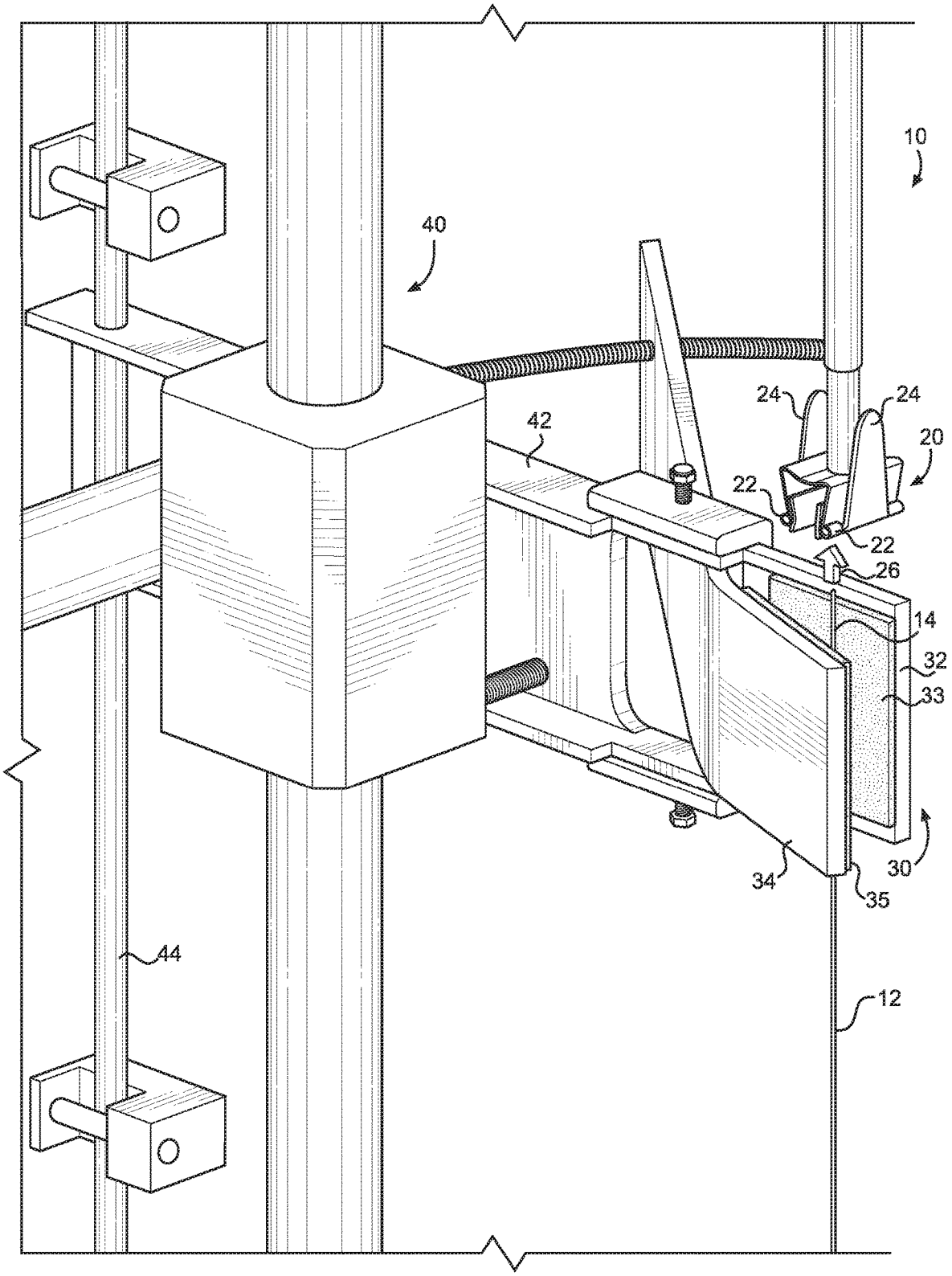
FIG. 1 provides a perspective view of an apparatus for polishing side surfaces of fibers having a fiber loading mechanism in a loading position, a polishing mechanism in an unclamped position, and a linear motion mechanism for linearly translating the polishing mechanism with respect to a fiber according to one embodiment of the invention.

Referring to FIGS. 1-5, an apparatus 10 for polishing a side surface of a fiber 12 according to an exemplary embodiment of the invention generally includes a fiber loading mechanism 20 for positioning the fiber 12 with respect to the apparatus 10. In this embodiment, the fiber loading mechanism secures a first end 14 of the fiber 12 to the apparatus 10. The apparatus 10 further includes a polishing mechanism 30 and a linear motion mechanism 40 for linearly translating the polishing mechanism 30 with respect to the fiber 12. In preferred embodiments, apparatus 10 is part of a computer numerical control (CNC) machining system that controls movement of one or more of the components of apparatus 10 and generally automates the polishing process described below. Thus, the apparatus 10 may be quickly programmable based on many different factors described further below including, but not limited to, the type/material of the fiber 12 being polished, the diameter of the fiber 12, the strength of the fiber 12, etc.

While apparatus 10 may be used for polishing a side surface of virtually any type of fiber 12 (including polymer and metal fibers), the apparatus 10 described below is more specifically intended to be utilized in connection with single, polycrystalline, and amorphous ceramic fibers having a diameter of about one millimeter or less and a strength between about 300 MPa and about 5 GPa. According to certain embodiments, the apparatus 10 may be used to polish the side surfaces of ceramic fibers 12 having a diameter as small as about eight microns. While any polishing of the fibers 12 using apparatus 10 should reduce the surface roughness of the side surfaces of the fibers 12 and make the cross-sectional shape of the fibers more evenly rounded for improved performance, surface roughness of fibers 12 (as measured by root mean square or "RMS") have been found to be minimized to as low as about 0.03 microns using apparatus 10 with a 0.5 micron diamond slurry for the polishing surfaces 33, 35 of the polishing mechanism 30. Lower surface roughness of fibers 12 are possible using a polishing slurry with smaller abrasive particles.

Figure 2:
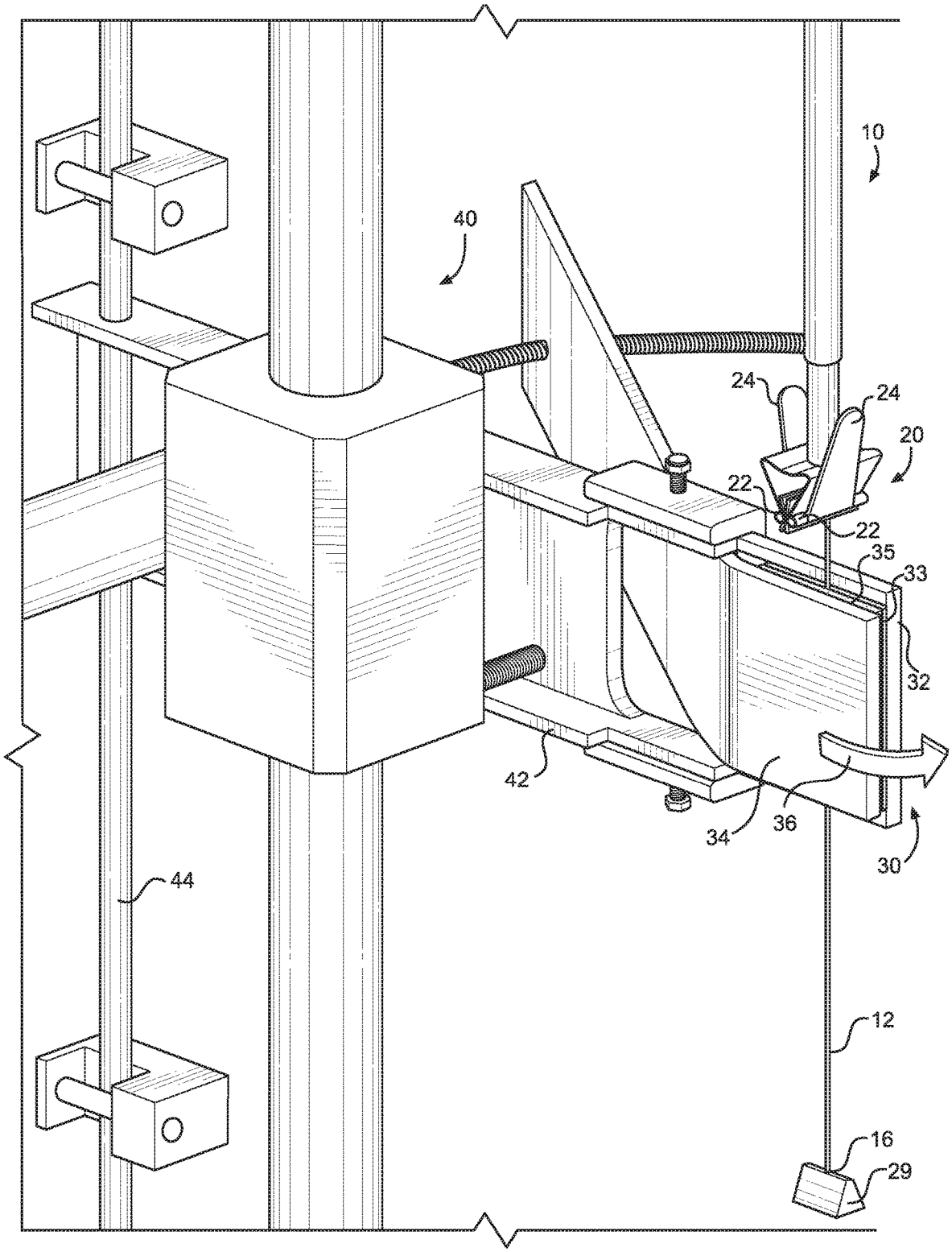
FIG. 2 provides a perspective view of the apparatus of FIG. 1 with a first end of the fiber secured to the fiber loading mechanism, the polishing mechanism in a clamped position around the fiber, and the linear motion mechanism in a first polishing position.

Referring specifically to FIGS. 1-2, fiber loading mechanism 20 may be in the form of a clamp/clip having at least two opposing ends 22 operable to move from a fiber loading position (FIG. 1) to a fiber loaded position (FIG. 2). In the fiber loading position, the opposing ends 22 are separated so that the first end 14 of the fiber 12 is able to be positioned between the opposing ends 22 as depicted by the arrow 26 of FIG. 1. In the fiber loaded position, the opposing ends 22 are compressed together to securely hold the first end 14 of the fiber 12 in the fiber loading mechanism 20 as depicted in FIG. 2.

In certain embodiments, the opposing ends 22 of the fiber loading mechanism 20 are able to be manually moved between the fiber loaded position and the fiber loading position. For example, the opposing ends 22 may be biased (e.g., spring-loaded) to the fiber loaded position. To move the opposing ends 22 from the fiber loaded position to the fiber loading position, the opposing ends 22 are operatively connected to respective handle portions 24. Pushing in on the handle portions 24 separates the opposing ends 22. Releasing the handle portions 24 would then allow the natural bias of the fiber loading mechanism 20 to bring the opposing ends 22 back together for engaging the first end 14 of the fiber 12.

Figure 6:
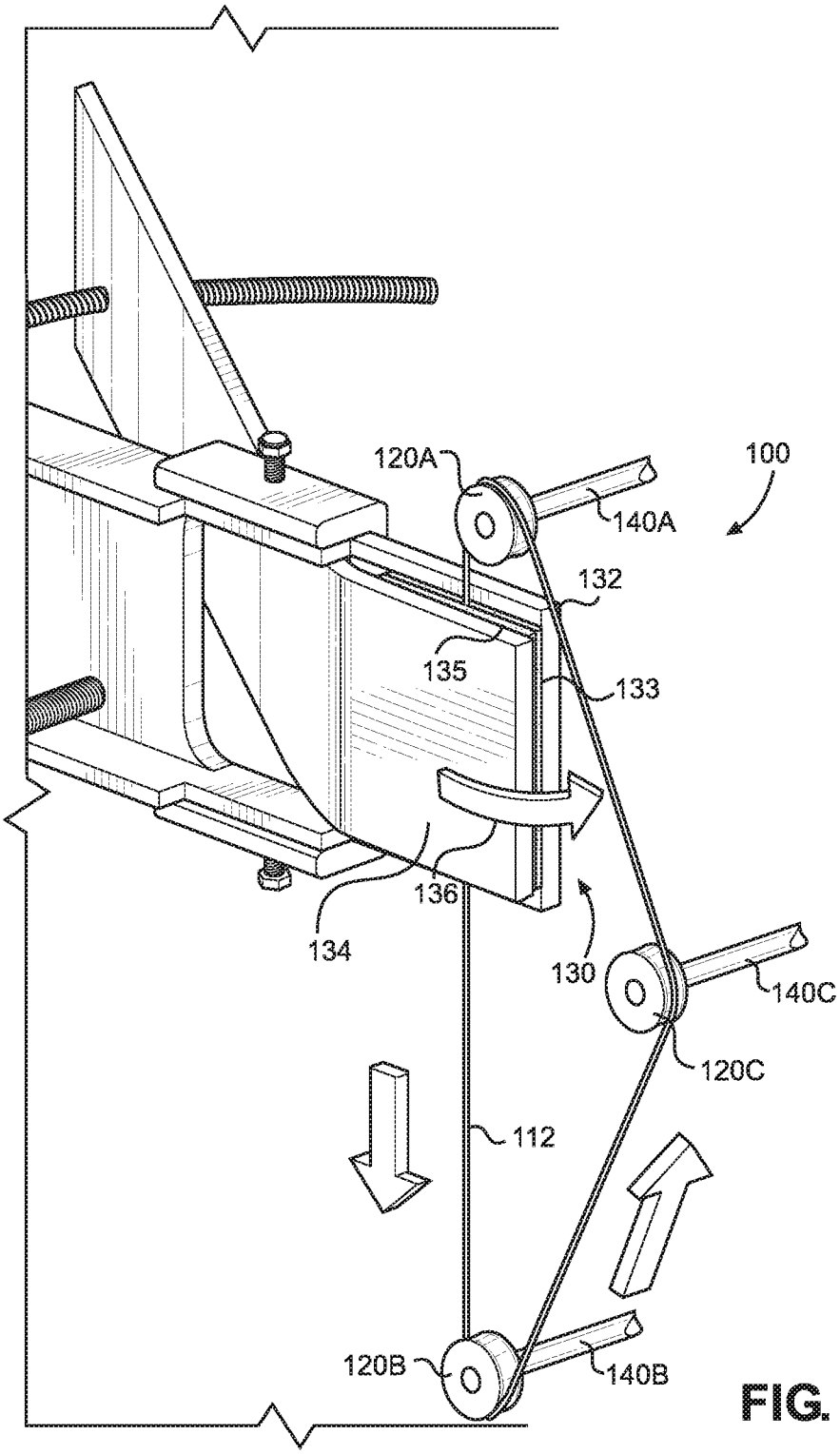
FIG. 6 provides a perspective view of an apparatus for polishing side surfaces of fibers where the linear motion mechanism linearly translates the fiber with respect to a stationary polishing mechanism according to another embodiment of the invention.
Figure 7:
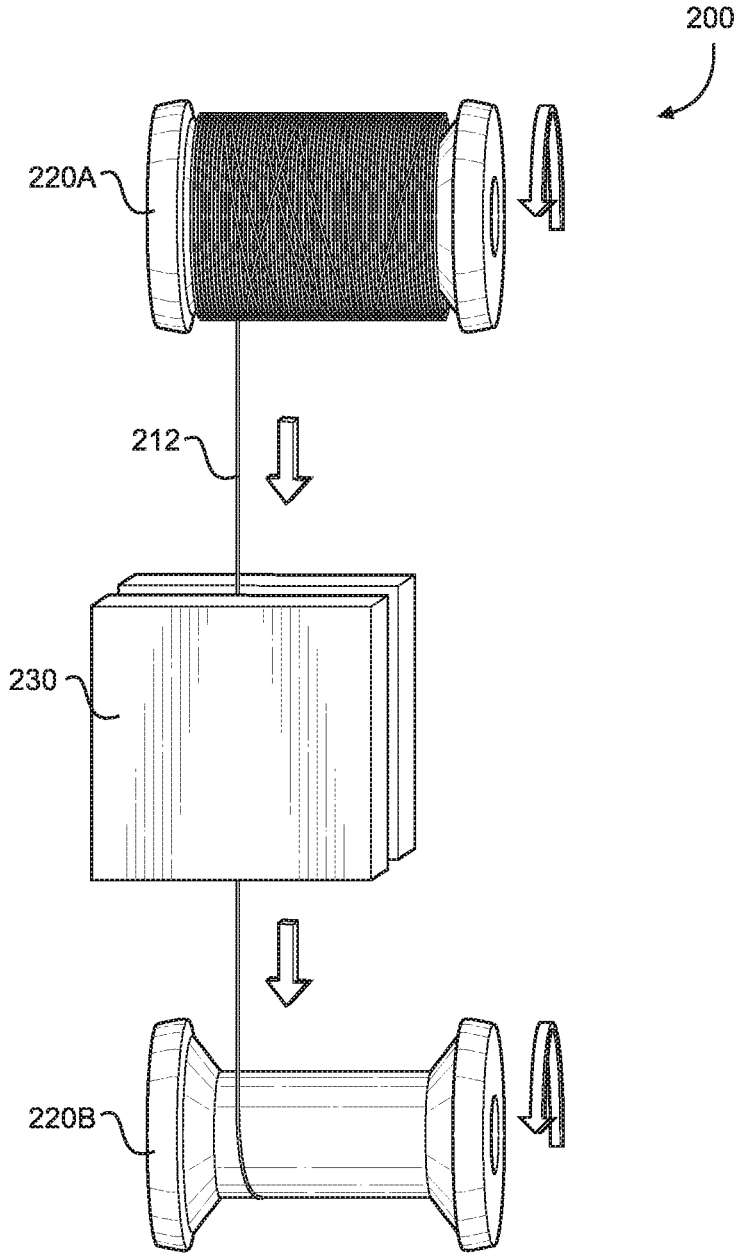
FIG. 7 provides a perspective view of an apparatus for polishing side surfaces of fibers where the fiber loading mechanism includes two or more spools, the polishing mechanism is disposed between the spools, and the linear motion mechanism linearly translates the fiber by rotating the spools according to another embodiment of the invention.

It should be understood that many other fiber loading mechanisms 20 may be used within the teachings of the present disclosure so long as the fiber loading mechanism 20 is able to sufficiently position the fiber 12 as desired. Further, the fiber loading mechanism 20 may be operated manually as described above or automatically using a CNC machining system. For example, fiber loading mechanism 20 may be in the form of a collet having a plurality of fiber loading segments (i.e., opposing ends) that are able to be tightened around the fiber 12 based on instructions from the CNC machining system. Other forms of the fiber loading mechanism 20 include, but are not limited to, adhesives, wedge grips, weave pulling grips, alligator grips, and one or more rollers or spools (as depicted in FIG. 6 and FIG. 7) in which the fiber 12 is wound.

According to certain embodiments, the fiber loading mechanism 20 is able to adjust its clamping pressure against the fiber 12 as desired. For example, different clamping settings may be provided and selected based on the strength of the fiber being polished. For example, strength of the commercially available alumina and silicon carbide fibers ranges between 2-3 GPa, so clamping pressure should be lower than 2 GPa of these fibers. While the fiber loading pressure may vary based on different factors including the strength of the fiber, the fiber loading pressure should typically be lower than the strength of the fiber.

As shown in FIG. 2, a second end 16 of the fiber 12 is secured to a tensioning mechanism 29 to provide desired tension to the fiber 12 during polishing. Desired tension of the fiber 12 is typically based on strength of the fiber 12 being polished, and, like fiber loading pressure, the tension should typically be lower than the strength of the fiber 12. In embodiments in which the top of the fiber 12 is secured to the apparatus 10 and the rest of the fiber hangs down vertically by gravity, the tensioning mechanism 29 may be a simple weight secured to the second end 16 of the fiber 12 as depicted in FIG. 2. According to this embodiment, different weight amounts could be used to adjust the tension of fiber 12 as desired. In other embodiments, the tensioning mechanism 29 may be constructed similar to its corresponding fiber loading mechanism 20. According to these embodiments, one of the fiber loading mechanism 20 or tensioning mechanism 29 may be movable to adjust the tension of the fiber 12. In yet another potential embodiment, the tensioning mechanism 29 could include a system for winding the fiber 12 for controlling the tension of fiber 12 such as described below in reference to FIG. 7.

With continued reference to FIGS. 1-2, polishing mechanism 30 according to this embodiment includes a first polishing pad 32 having a first polishing surface 33 and a second polishing pad 34 having a second polishing surface 35. In operation, typically after a fiber 12 is secured to fiber loading mechanism 20, the polishing mechanism 30 is operable to move between an unclamped position (FIG. 1) and a clamped position (FIG. 2). In the unclamped position, the fiber 12 is able to be loosely positioned between the first polishing pad 32 and the second polishing pad 34. In the clamped position, the first polishing pad 32 and the second polishing pad 34 are clamped together as depicted by arrow 36 of FIG. 2 such that the first polishing surface 33 contacts the second polishing surface 35 with a portion of the fiber 12 tightly positioned therebetween.

According to certain embodiments, both the first polishing surface 33 and second polishing surface 35 will have an abrasive surface with an average abrasive particle size of less than about fifteen microns. In certain embodiments, the polishing surfaces 33, 35 of each polishing pad 32, 34 are easily removed and replaced. Thus, polishing surfaces having abrasive surfaces of varying average abrasive particle size may be utilized as desired. For example, according to certain embodiments, the abrasive particle sizes of the polishing surfaces 33, 35 could get successively smaller by replacing polishing pads 32, 34. In this regard, if the polishing surfaces 33, 35 with the smallest abrasive particle sizes are employed from the beginning, it may take a longer time to polish the fiber 12 as desired. Thus, if the fiber 12 is strong enough, pads 32, 34 with coarser polishing surfaces 33, 35 may be used at the beginning of the polishing and then replaced with pads 32, 34 having smaller abrasive particle sizes to reduce the polishing time. Similarly, when it is desired to reduce the diameter of fiber 12 while polishing, pads 32, 34 with coarse polishing surfaces 33, 35 can be utilized first to reduce the diameter and then replaced with pads 32, 34 having finer polishing surfaces 33, 35 to complete the polishing.

According to other embodiments of the invention, the first polishing surface 33 and second polishing surface 35 may be provided without embedded abrasive particles. According to this embodiment, the abrasive particles may be provided by pumping polishing slurries through flexible tubing to first polishing pad 32 and second polishing pad 34 in the clamped position as known in the art. According to this embodiment, various abrasive sizes can be used by changing the particular polishing slurry being pumped to the polishing surfaces 33, 35.

Figure 3:
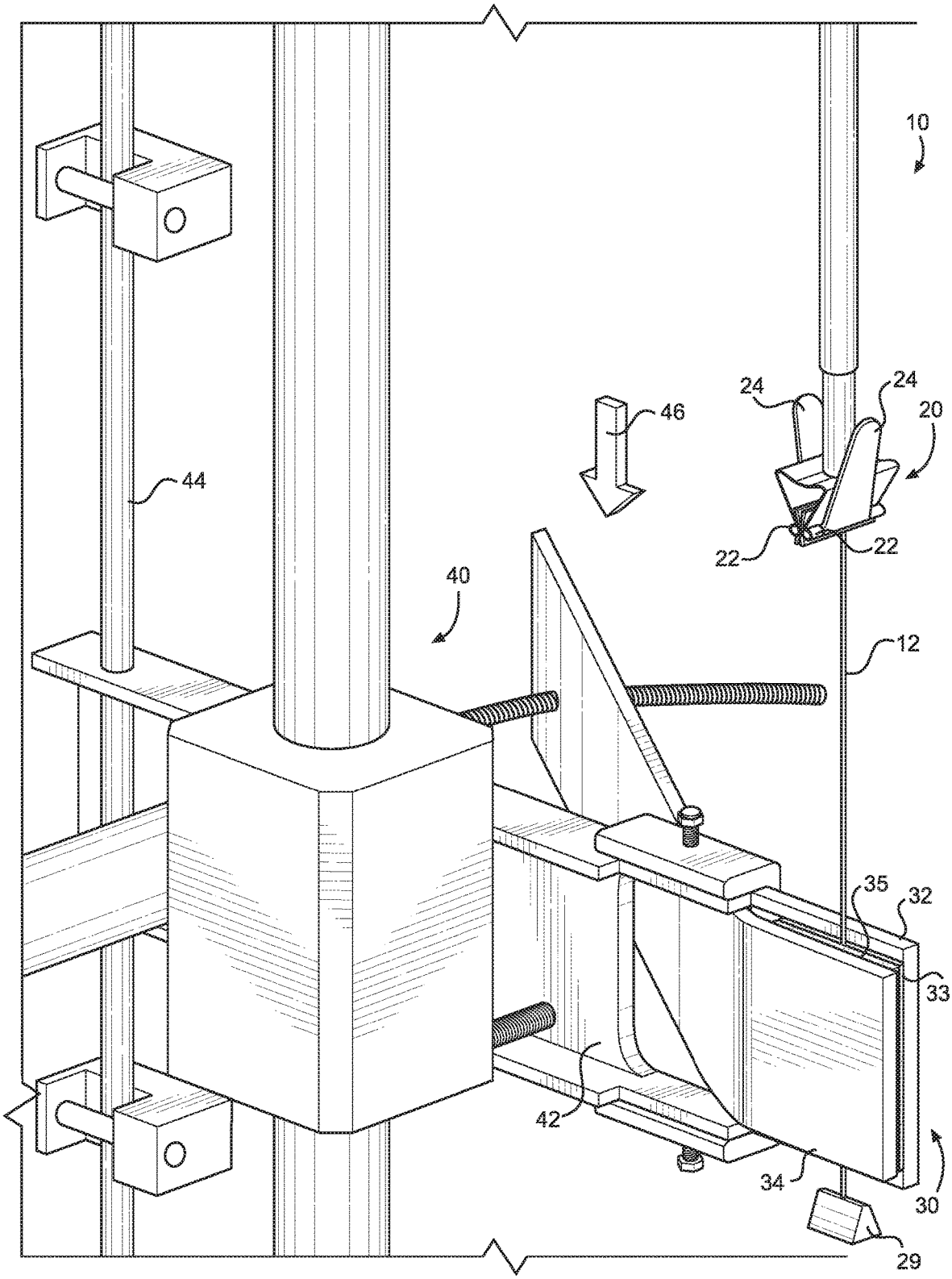
FIG. 3 provides a perspective view of the apparatus of FIGS. 1-2 after the linear motion mechanism has moved from the first polishing position of FIG. 2 to a second polishing position.

With reference to FIGS. 2-3, the linear motion mechanism 40 is operable to move the polishing mechanism 30 from a first polishing position (FIG. 2) to a second polishing position (as depicted by arrow 46 of FIG. 3) after the fiber 12 is loaded to the apparatus 10 via the fiber loading mechanism 20 and the fiber 12 is tightly positioned between the first polishing pad 32 and the second polishing pad 34 via the polishing mechanism 30. Movement of the polishing mechanism 30 from the first polishing position to the second polishing position results in the first and second polishing surfaces 33, 35 polishing the side surface of the fiber 12. It should be understood that the linear motion mechanism 40 may move the polishing mechanism 30 between the first and second positions as many times as desired. Further, the linear motion mechanism 40 may move the polishing mechanism 30 while the pads 32, 34 are in the clamped position or in the unclamped position. For example, according to certain embodiments, the linear motion mechanism 40 moves the polishing mechanism 30 in the clamped position from the first polishing position to the second polishing position and then unclamps the polishing mechanism before moving the linear motion mechanism back to the first polishing position. In other embodiments, typically with fiber end 16 gripped in a fixed position rather than tensioned with a weight, the linear motion mechanism may move the polishing mechanism 30 from the second polishing position back to the first polishing position without unclamping the polishing mechanism 30.

In certain embodiments, the linear motion mechanism 40 includes a connecting arm 42 that fixedly connects the polishing mechanism 30 to the linear motion mechanism 40. According to this embodiment, the connecting arm 42 moves the polishing mechanism 30 when the linear motion mechanism 40 is linearly moved. One or more stabilizing tracks 44 may be provided to assist in holding the connecting arm 42 and polishing mechanism 30 steady while being moved between the first polishing position and the second polishing position.

According to certain embodiments, the linear motion mechanism 40 is a pneumatic linear actuator for providing precise and consistent linear movement of the polishing mechanism 30 based on instructions from the CNC machining system. In typical embodiments, the velocity of the linear motion mechanism 40 is between about 0.2 in/sec to about 20 in/sec, and most preferably about 3 in/sec to about 4 in/sec.

Figure 4:
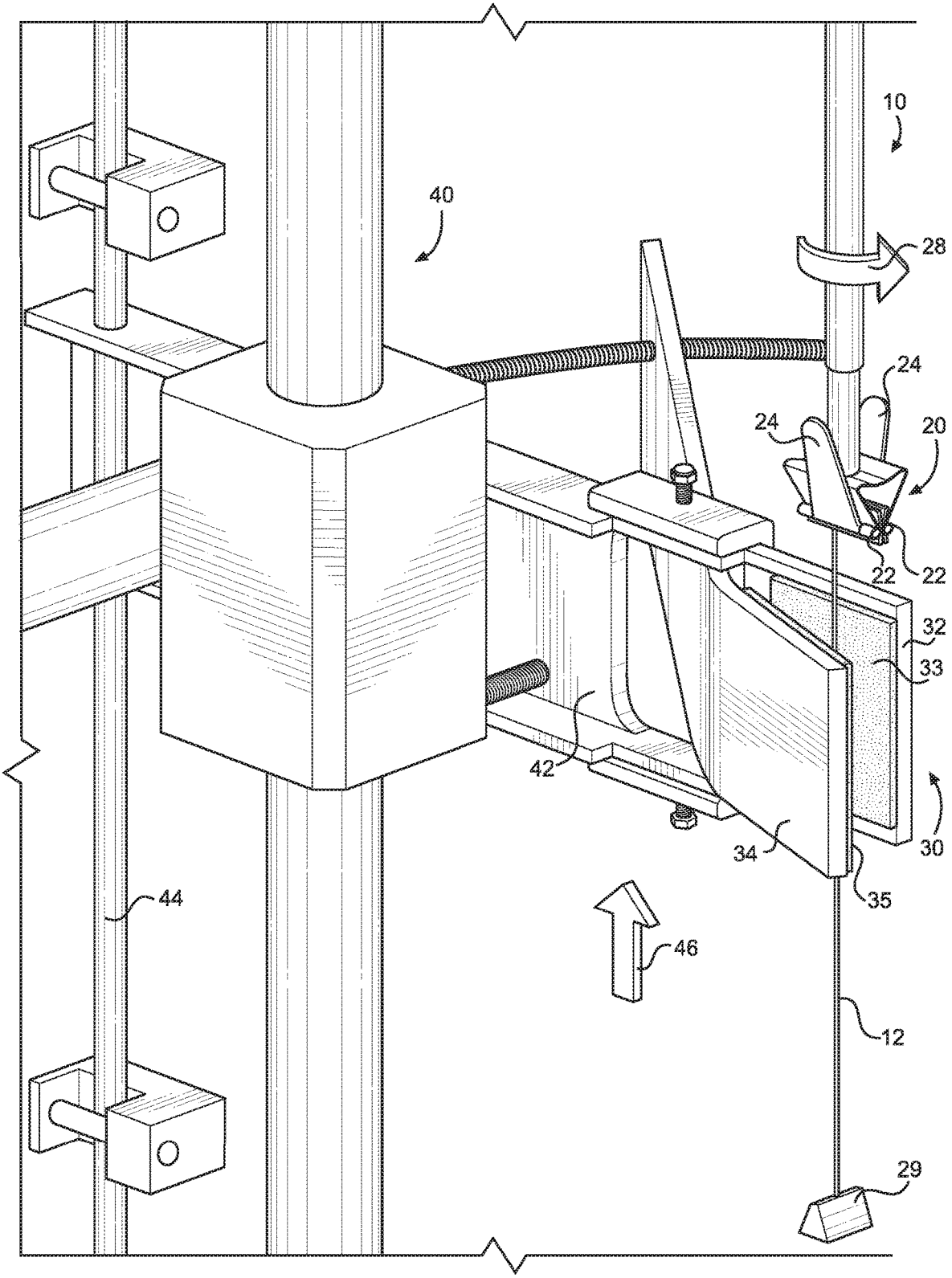
FIG. 4 provides a perspective view of the apparatus of FIGS. 1-3 with the linear motion mechanism moved back to the first polishing position, the polishing mechanism in the unclamped position, and the fiber loading mechanism being axially rotated for axially rotating the fiber.
Figure 5:
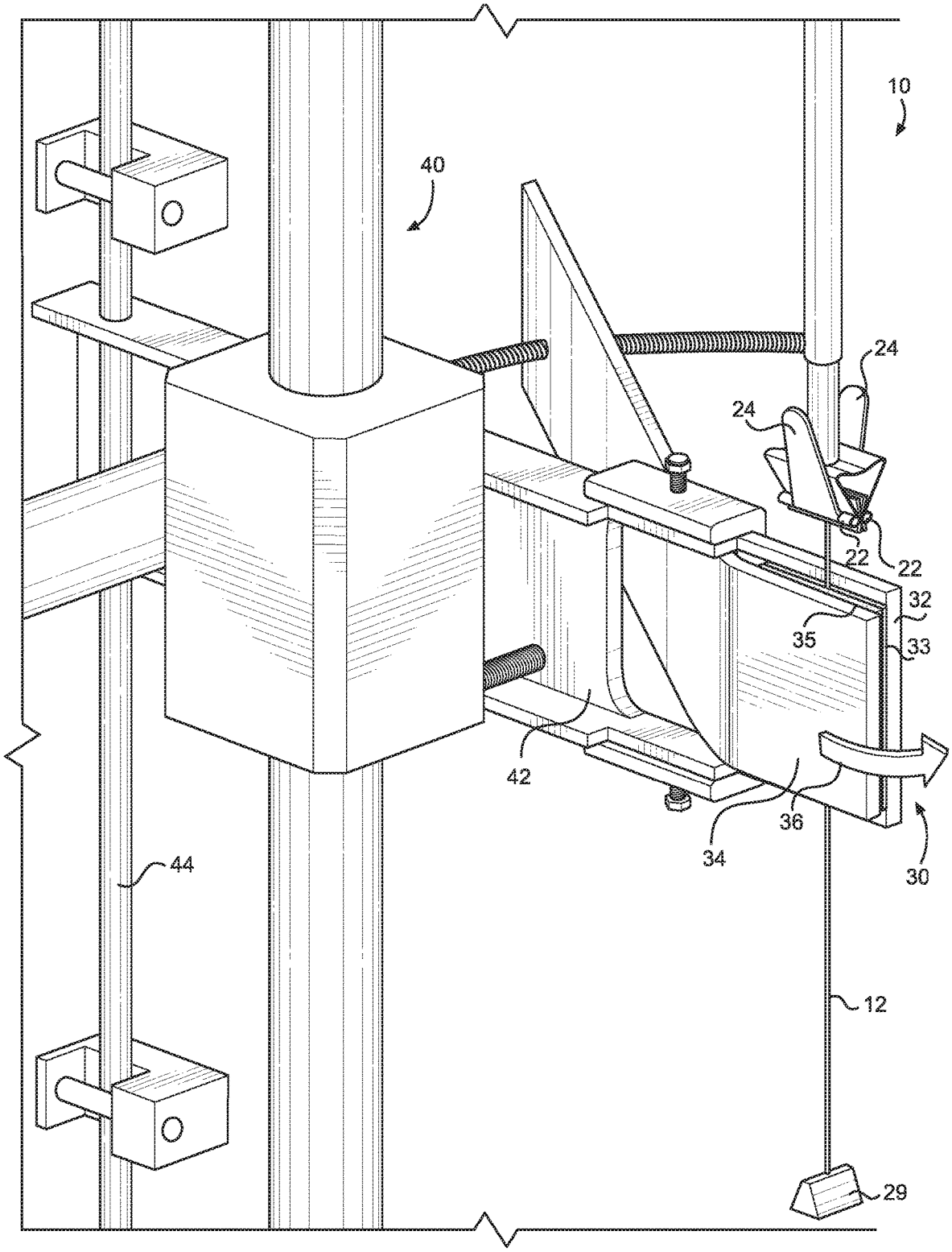
FIG. 5 provides a perspective view of the apparatus of FIGS. 1-4 after the polishing mechanism has moved back to the clamped position with respect to FIG. 4 for polishing the axially rotated fiber.

Referring to FIGS. 4-5, and according to another aspect of the invention, the fiber loading mechanism 20 is operable to be axially rotated to provide a more consistent polishing of the side surface of the fiber 12. In this regard, the pads 32, 34 of the polishing mechanism 30 will typically apply greater pressure to the immediate areas in which the fiber 12 contacts the polishing surfaces 33, 35. Thus, after one or more movements of the polishing mechanism 30 between the first polishing position and the second polishing position, the polishing mechanism 30 is moved to the unclamped position and the fiber loading mechanism 20 is axially rotated as depicted by arrow 28 of FIG. 4. After the fiber loading mechanism 20 is axially rotated, the polishing mechanism is moved back to the clamped position as depicted by arrow 36 of FIG. 5. The sequence of FIGS. 2-3 for moving the polishing mechanism 30 from the first polishing position to the second polishing position may then be repeated for further polishing of the axially rotated fiber 12.

It should be understood that fiber 12 may be axially rotated as many times as desired. The more times the fiber 12 is axially rotated, generally the more consistent the polishing of the finished fiber 12, though each additional axial rotation increases polishing time with increasing less effect on the end fiber. In typical embodiments, the fiber 12 will be axially rotated at least once (i.e., 45°), which will provide at least four immediate contact areas of the fiber 12 during as few as two movements of the linear motion mechanism between the first polishing position and the second polishing position.

While the linear motion mechanism 40 is shown in FIGS. 1-5 and described above as being connected to the polishing mechanism 30 to linearly translate the polishing pads 32, 34 with respect to a stationary fiber 12, it should be understood that linear motion mechanism 40 could be similarly connected to the fiber loading mechanism 20 for linearly translating the fiber 12 with respect to stationary polishing pads 32, 34. In other words, the linear motion mechanism 40 linearly translates the fiber 12 instead of the polishing mechanism 30.

Similarly, referring to apparatus 100 of the embodiment of FIG. 6, the fiber loading mechanism 120 may include a plurality of rollers 120A, 120B, 120C for positioning a fiber 112 with respect to apparatus 100 by wrapping or winding the fiber 112 around the rollers. According to this embodiment, the linear motion mechanism 140 is in the form of a rotating drive mechanism 140A, 140B, 140C connected to one or more of the rollers 120A, 120B, 120C for moving the fiber 112 between the rollers. According to certain embodiments, one or more polishing mechanisms 130 are operable to clamp polishing pads 132, 134 having respective polishing surfaces 133, 135 around fiber 112 as described above with respect to apparatus 10. Thus, in operation, linear drive mechanism 140 linearly translates fiber 112 between two or more rollers (120A and 120B as depicted in FIG. 6) such that the stationary polishing mechanism 130 is able to polish the side surface of the fiber 112 as it moves between the rollers.

In other embodiments, one or more of rollers 120A, 120B, and/or 120C may include an abrasive surface for polishing the fibers 112. Rollers with abrasive surfaces may be a replacement for polishing pads 132, 134, or they may be in addition to the polishing pads. In certain embodiments, particularly when a roller includes an abrasive surface for polishing, one or more of the rollers may be stationary while the fiber translates/rolls across the roller. For example, roller 120A could be rotated by linear motion mechanism 140A while rollers 120B and 120C have an abrasive surface and are held stationary for polishing fiber 112 that is being linearly translated via the linear motion mechanism 140 rotating roller 120A.

According to certain embodiments, one or more of the rollers may be in the form of spools from which the fiber 112 can be wound and unwound. For example, referring to apparatus 200 of FIG. 7, rollers in the form of spools 220A and 220B may be concurrently rotated such that spool 220A unwinds fiber 212 and spool 220B rewinds fiber 212 after polishing is completed (i.e., after fiber 212 has been linearly translated past polishing mechanism 230). According to this embodiment, one of spool 220A and spool 220B may be wound independently of the other spool to adjust the tensioning of the fiber 112.

It is noted that the embodiments exemplified in FIGS. 6 and 7 are believed to be particularly useful for surface polishing a long fiber wound between the multiple rollers. According to these embodiments, the fiber can wound between rollers/spools to reduce the footprint of the apparatus. Further, according to these embodiments, and particularly when one or more of the rollers themselves include the polishing mechanism in the form of abrasive surfaces, the fiber can be linearly translated between the rollers at a quicker pace, such as up to about 35 in/sec. It should be understood that any number of rollers/spools could be used based on the length of the fiber 112, 212 being polished and or the desired path of the fiber between the rollers/spools. For example, certain embodiments could have two rollers in the form of spools (such as shown in FIG. 7) with one or more rollers (such as shown in FIG. 6) disposed between the spools. According to this embodiment, the rollers between the spools could include abrasive surfaces for polishing the fiber as the fiber translates from the first spool to the second spool. The rollers could also be disposed at different angles to vary the particular side of the fiber being polished as the fiber is linearly translated past the rollers having abrasive surfaces.

Further, according to the embodiments of FIGS. 6 and 7, as well as any other embodiment in which the fiber 12, 112, 212 is linearly translated, the polishing mechanism 30, 130, 230 could be operable to be axially rotated instead of the fiber loading mechanism 20, 120, 220 in order to provide a consistent polishing around the fiber 12, 112, 212. Alternately, or in addition to axially rotatable polishing mechanisms, multiple fiber polishing mechanisms having various angled positions of their respective polishing surfaces could be positioned along the path in which the fiber is linearly translated for providing a consistent polishing around a particular fiber without having to rotate the fiber or the polishing mechanisms.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

The invention claimed is:

1. An apparatus for polishing a side surface of a fiber, the apparatus comprising:

a fiber loading mechanism for positioning the fiber with respect to the apparatus;

a polishing mechanism including at least a first polishing pad having a first polishing surface and a second polishing pad having a second polishing surface, the polishing mechanism configured to clamp the first polishing pad and the second polishing pad together such that the first polishing surface contacts the second polishing surface with a portion of the fiber disposed between the first and second polishing surfaces; and a linear motion mechanism for linearly translating one of the polishing mechanism and the fiber for polishing a side surface of the fiber after the first polishing pad and the second polishing pad are clamped together with the portion of the fiber disposed between the first and second polishing surfaces.

2. The apparatus of claim 1 wherein the fiber loading mechanism is configured to axially rotate to thereby axially rotate the fiber secured to the fiber loading mechanism.

3. The apparatus of claim 1 wherein the linear motion mechanism is configured to linearly translate the polishing mechanism while the fiber loading mechanism is stationary.

4. The apparatus of claim 1 wherein the linear motion mechanism is configured to linearly translate the fiber while the polishing mechanism is stationary.

5. The apparatus of claim 1 wherein the fiber loading mechanism includes a plurality of rollers and the linear motion mechanism is configured to linearly translate the fiber between the plurality of rollers.

6. The apparatus of claim 1 wherein the polishing mechanism is configured to clamp the first polishing pad to the second polishing pad according to a plurality of clamping pressures.

7. The apparatus of claim 1 further comprising a tensioning mechanism to provide a desired tension to the fiber.

8. A method of polishing side surfaces of a fiber, the method comprising:

providing a polishing apparatus including:

a fiber loading mechanism, a polishing mechanism including at least a first polishing pad having a first polishing surface and a second polishing pad having a second polishing surface, the polishing mechanism configured to clamp the first polishing pad and the second polishing pad together, a linear motion mechanism for linearly translating one of the polishing mechanism and the fiber;

positioning the fiber in the fiber loading mechanism such that a portion of the fiber is disposed between the first polishing pad and second polishing pad of the polishing mechanism;

clamping the first polishing pad and the second polishing pad together such that the first polishing surface contacts the second polishing surface with the portion of the fiber disposed between the first and second polishing surfaces; and linearly translating one of the polishing mechanism and the fiber for polishing at least a first side surface of the fiber.

9. The method of claim 8 wherein the linearly translating step includes linearly translating the polishing mechanism for polishing the first side surface of the fiber, the method further comprising:

unclamping the first polishing pad and the second polishing pad;

axially rotating the fiber loading mechanism to thereby axially rotate the fiber secured to the fiber loading mechanism;

re-clamping the first polishing pad and the second polishing pad together with the axially rotated fiber disposed between the first and second polishing surfaces; and linearly translating the polishing mechanism for polishing at least a second side surface of the fiber.

10. The method of claim 8 further comprising selecting a clamping pressure for application of the polishing mechanism against the fiber based on the strength of the fiber being polished.

11. The method of claim 8 wherein the linearly translating step includes linearly translating the polishing mechanism while the fiber loading mechanism is stationary.

12. The method of claim 8 wherein the linearly translating step includes linearly translating the fiber while the polishing mechanism is stationary.

13. The method of claim 8 wherein the apparatus further comprises a tensioning mechanism, the method further includes adjusting a tension of the fiber by modifying the tensioning mechanism.

14. The method of claim 8 wherein the fiber includes a maximum diameter of one millimeter or less.

15. The method of claim 8 wherein the fiber is one of a monocrystalline, polycrystalline, and amorphous ceramic fiber having a maximum diameter of one millimeter or less.

16. The method of claim 8 wherein the fiber loading mechanism includes a plurality of rollers and the linearly translating step includes linearly translating the fiber between the plurality of rollers while the polishing mechanism is stationary.

17. The method of claim 16 wherein the plurality of rollers includes at least a first spool and a second spool, the linearly translating step including unwinding the fiber from the first spool while re-winding the fiber with the second spool.

* * * * *